United States Patent [19]

Giudice

[11] 3,953,761

[45] Apr. 27, 1976

[54] FLUORESCENT LIGHT BULB FOR USE IN CONVENTIONAL INCANDESCENT BULB FIXTURE

[76] Inventor: Thomas Lo Giudice, 520 E. 72 St., New York, N.Y. 10021

[22] Filed: Apr. 3, 1974

[21] Appl. No.: 457,656

[52] U.S. Cl. ..... 315/71; 240/51.12

[51] Int. Cl.[2] ..... H01J 61/00

[58] Field of Search ..... 315/71, DIG. 5; 339/50 R, 50 C, 51, 147 P, 167; 240/51.11 R, 51.12

[56] References Cited

UNITED STATES PATENTS

| | | | |
|---|---|---|---|
| 2,061,824 | 11/1936 | Beymer | 240/51.12 |
| 2,279,635 | 4/1942 | Morley | 339/167 X |
| 2,365,812 | 12/1944 | Friend | 240/51.12 |
| 2,405,518 | 8/1946 | Polevitzky | 240/51.12 X |
| 3,191,087 | 6/1965 | Sugiyama et al. | 240/51.11 R X |
| 3,815,080 | 6/1974 | Summa | 240/51.11 R X |

*Primary Examiner*—James B. Mullins
*Attorney, Agent, or Firm*—Lewis H. Eslinger

[57] ABSTRACT

The fluorescent light bulb of the present invention is adapted to be used in the socket of a conventional incandescent bulb fixture and includes a centrally located ballast electrically connected to a socket plug which is adapted to be received in the socket of the fixture. A fluorescent tube or envelope substantially completely surrounds and encloses the central ballast. The fluorescent tube has electrical contacts formed therein which are in electrical connection to the ballast in order to form a compact fluorescent light bulb assembly.

6 Claims, 12 Drawing Figures

FIG. 1
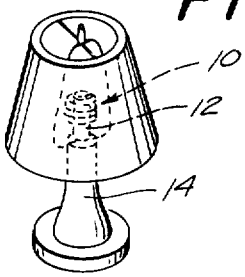
FIG. 2
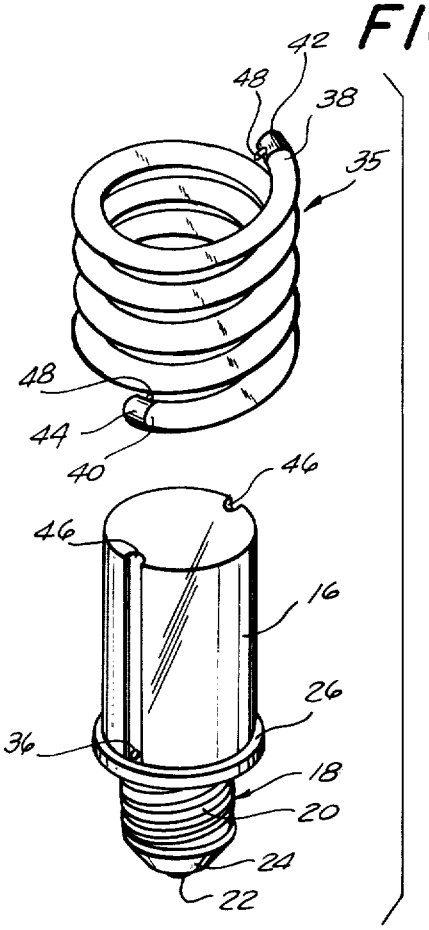
FIG. 3
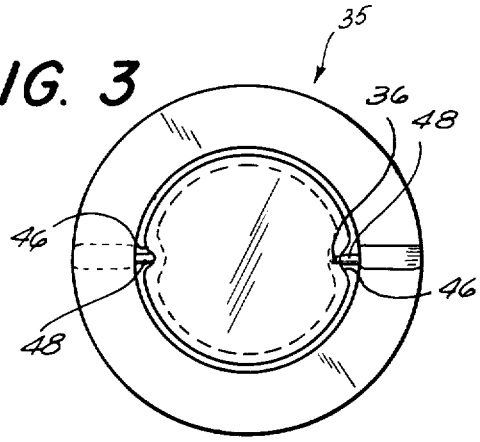
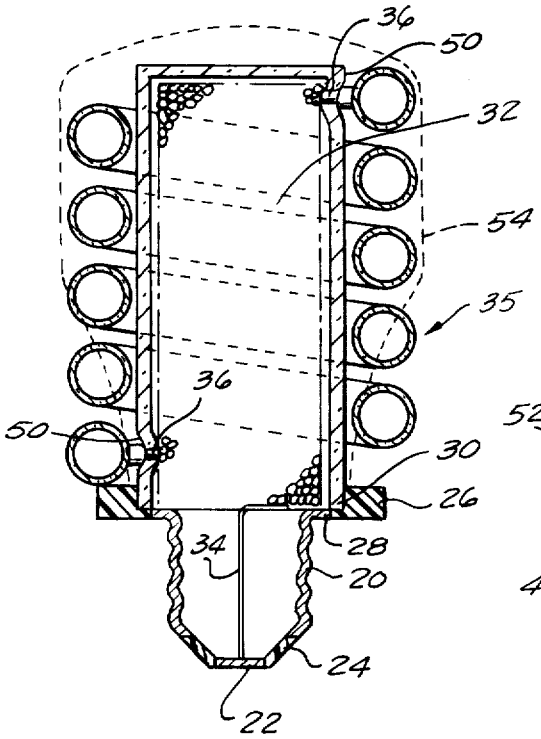
FIG. 5
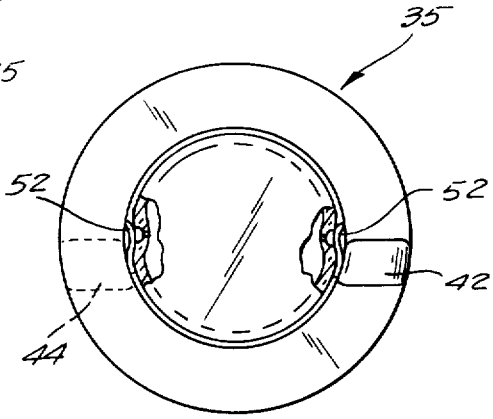
FIG. 4

FIG. 9
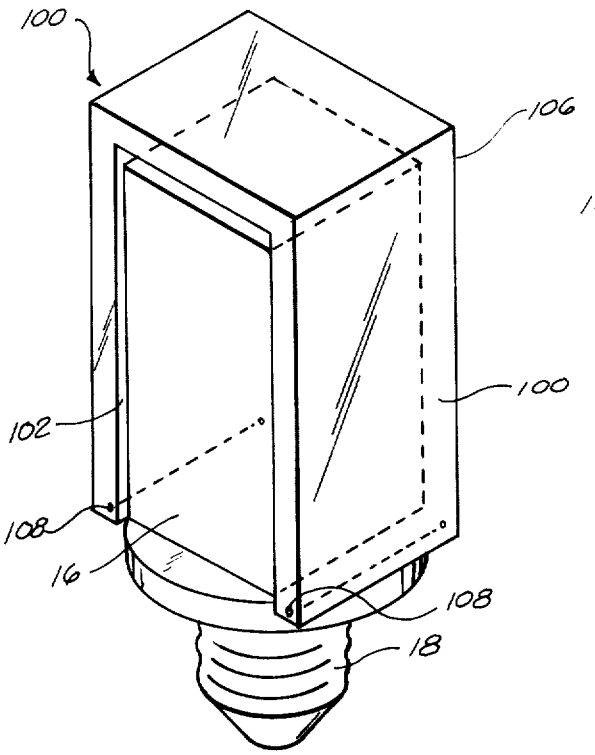
FIG. 10
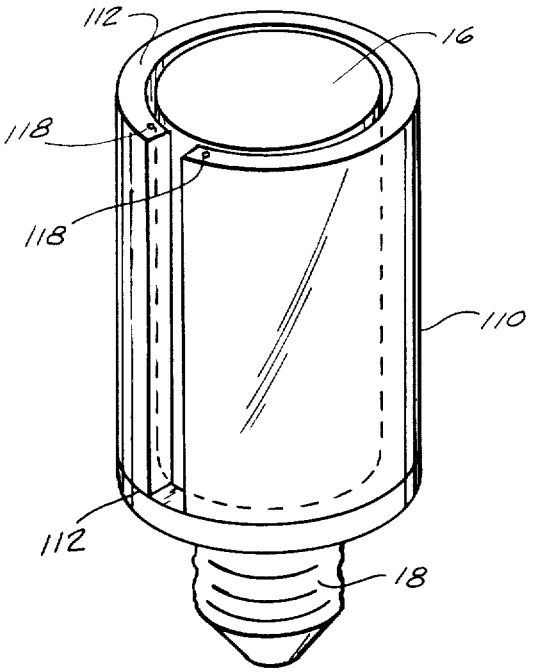
FIG. 11
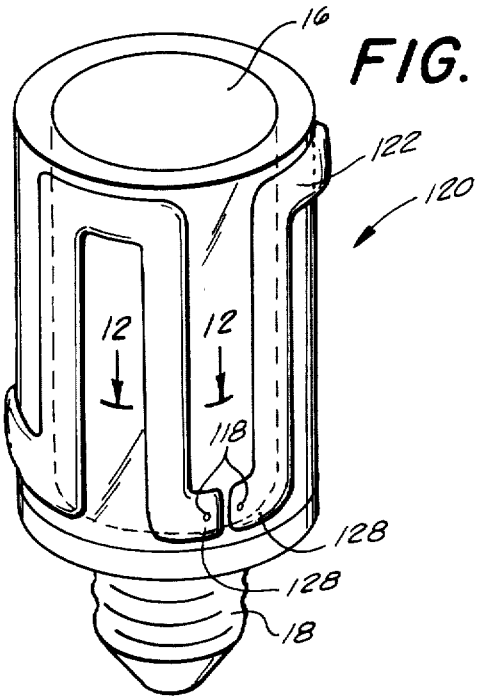
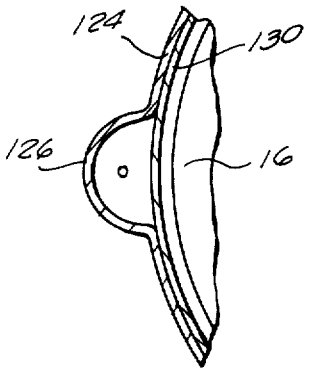
FIG. 12

FLUORESCENT LIGHT BULB FOR USE IN CONVENTIONAL INCANDESCENT BULB FIXTURE

The present invention relates to electric light bulbs, and more particularly to a fluorescent light bulb which is adapted to be used in the socket of a conventional incandescent lamp.

The majority of light fixtures manufactured at present, particularly light fixtures for use in the home, namely ceiling fixtures, table lamps, floor lamps, and the like, are constructed to be used with conventional incandescent lamp bulbs. Such bulbs are relatively inefficient in their consumption of energy as compared to fluorescent light bulbs. In fact, a fluorescent light bulb consumes approximately 1/6 of the energy or electrical current required by an incandescent bulb to produce the same amount of light output. Thus, particularly in the present days of a severe energy crisis, substantial energy savings could be effected by the use of fluorescent light bulbs in lieu of incandescent bulbs. Unfortunately, fluorescent bulbs have heretofore not been adaptable for use in the sockets of conventional incandescent lamps or lamp fixtures.

As is well known fluorescent bulbs are peculiarly adapted for use only with certain fixtures specifically designed to accept such bulbs. Such typical fixtures are generally of the type using long straight or circular fluorescent tubes within specialized fluorescent bulb fixtures.

Although there have been a few proposed fluorescent light bulb constructions for use in incandescent bulb sockets, such as for example the bulbs shown in U.S. Pat. Nos. 2,298,961 and 2,697,777, such structures have not been acceptable in the past. Typically such bulbs use conventional circular fluorescent tubes which require specialized electrical connectors for the ends of the tubes and specialized mounting arrangements to accommodate the large circular tubes. Thus, not only are these structures unsightly in appearance, but they are not adaptable for use in conventional lamps and floor lamps, which are constructed particularly to receive bulbs of the incandescent bulb size.

Accordingly it is an object of the present invention to provide a fluorescent light bulb which is adapted to be used in lieu of incandescent bulbs in any incandescent bulb fixture.

Another object of the present invention is to provide a compact fluorescent light bulb assembly which can be used in lieu of an incandescent bulb.

Yet another object of the present invention is to provide a highly efficient and long lasting bulb for use in an incandescent lamp socket.

A still further object of the present invention is to provide a compact fluorescent light bulb which is pleasing in appearance and durable in construction.

In accordance with an aspect of the present invention, a fluorescent bulb adapted to be used in the socket of a conventional incandescent lamp fixture, such as a table lamp or the like, consists of a threaded socket plug which is adapted to be threadably mounted in the conventional socket of an incandescent lamp fixture. A generally cylindrical housing connected to the socket plug and extending generally axially therefrom contains an electrical ballast for a fluorescent light bulb which ballast is in electrical connection to the two terminals of the socket. The central cylindrical housings is surrounded by a curved fluorescent tube, wound about the periphery of the housing, in a helix having a predetermined number of turns, with the ends of the tubes being electrically connected through the housing to the ballast.

Preferably the electrical connection between the tube and the ballast is such that the tube can be removed and replaced as desired. As a result a compact flourescent light bulb assembly is provided which has an exterior configuration substantially conforming to that of conventional incandescent light bulbs so that the fluorescent light bulb can be used in a conventional incandescent lamp fixture.

The above, and other objects, features, and advantages of this invention will be apparent in the following detailed description of illustrative embodiments thereof which are to be read in connection with the accompanying drawings, wherein:

FIG. 1 is a persepective view of a conventional incandescent bulb table lamp using a fluorescent light bulb constructed in accordance with the present invention;

FIG. 2 is an enlarged exploded perspective view of a fluorescent light bulb constructed in accordance with the present invention;

FIG. 3 is a plan view of the assembled bulb of FIG. 1;

FIG. 4 is a plan view similar to FIG. 3 of another embodiment of the present invention;

FIG. 5 is a sectional view taken along line 5—5 of FIG. 4;

FIGS. 9–11 are perspective view of three further embodiments of the present invention; and FIG. 12 is a sectional view taken along line 12—12 of FIG. 11.

Figure 8:
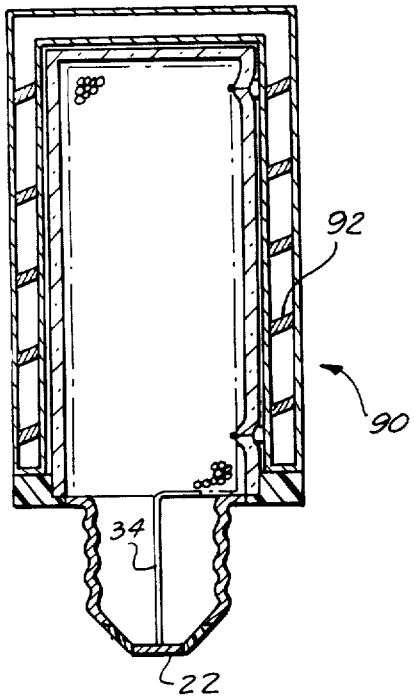
FIG. 8 is a sectional view similar to FIG. 6 of yet another embodiment.

Referring now to the drawing in detail, and initially to FIG. 1 thereof, it will be seen that a fluorescent light bulb 10, constructed in accordance with one embodiment of the present invention, is used in the socket 12 of a conventional lamp 14, constructed to accept a conventional incandescent light bulb in its socket. The configuration of bulb 10 is such that it is used in lieu of a conventional light bulb to provide an equivalent amount of light at a more efficient rate of enery consumption.

Bulb 10 is shown in greater detail in FIG. 2, wherein it is seen that the bulb consists of a central housing 16 formed of any convenient material such as glass, metal or plastic, and secured to a socket plug 18. The latter is a threaded hollow plug, in the form of a conventional incandescent lamp plug, having an electrically conductive threaded side portion or terminal 20 and a central conductive terminal 22 separated from terminal 20 by an insulating material 24 (see FIG. 5). Housing 16 and plug 18 are secured to each other in any convenient manner, as for example by an annular collar 26, in which the ends 28, 30 of the socket and housing respectively are secured by a heat resistant adhesive material or the like.

Housing 16 contains therein an electrical transformer or ballast 32, such as is normally used with fluorescent light bulbs, as will be understood by those skilled in the art. Ballast 32 is connected to the electrical terminals 20,22 of socket 18 in any convenient manner, as for example by leads 34. The ballast is also connected to the fluorescent tube 35 of bulb 10 through contacts 36 (only one of which is seen in FIG. 2) which extend from the ballast through openings in housing 16.

Fluorescent tube 35, as seen in FIG. 2, is wound in a helix, having a predetermined number of closely spaced (within ¼ inch) turns, depending upon the desired light output for the tube. The helix is wound with an internal diameter that is slightly larger than the diameter or maximum width dimension of housing 16 so that it can receive the housing, as described hereinafter.

Preferably tube 35 is formed of a glass material, such as a leaded glass, which is heat-treated to permit the glass to be wound in the helical configuration shown. However, it is contemplated that a number of plastic materials can also be used. The tube has opposed ends 38, 40 which are sealed in any convenient manner after the tube is evacuated and coated with a conventional fluorescent material. Typically these ends include inserted plugs 43, 44 respectively, which provide for electrical connection between the tube and the ballast. In addition, one of the plugs is provided with a starter element such as is conventionally used with fluorescent tube and ballast assemblies.

In the embodiments of the invention illustrated in FIGS. 2 and 3, the electrical connection between tube 35 and ballast 32 (contained within housing 16) is facilitated by the provision of a pair of elongated slots or recesses 46 formed at diametrically opposed locations in the exterior surface of housing 16. These slots accommodate bayonet pins or contacts 48 extending radially inwardly from plugs 42, 44 at the ends of tube 35. Thus, as seen in FIG. 3, when tube 35 is slid downwardly over housing 16 with pins 48 within recesses 46, the pins will be properly located to engage the ballast contacts 36 when the tube is fully seated on the ballast housing.

By constructing the bulb assembly in this manner, the home owner can readily change the fluorescent tube when desired, as for example when the tube burns out. This is a highly practical arrangement since the ballast used with fluorescent light bulbs has a substantially infinite life expectancy so that it rarely, if ever, has to be replaced. By providing the bayonet end recess type arrangement described above the consumer can readily change the fluorescent tube without having to manually disconnect the electrical contacts in the tube assembly, as is typically required in previously proposed constructions.

Another contact arrangement for providing electrical connection between the tube 35 and ballast 32, is illustrated in FIGS. 4 and 5. In this embodiment of the invention the exterior surface of housing 16 is simply provided with a pair of recesses 50, located at diametrically opposed locations on the periphery of housing 16, but with one of the recesses located adjacent the base 26 and the other of the recesses located adjacent the upper end of the housing. In this embodiment ballast contacts 36 are located in the base of these recesses to provide the necessary electrical connection.

Tube 35, in this embodiment has plugs 42,44 in its ends, in the manner described above, but the electrical contacts which extend therefrom are provided as spring fingers 52 which are curved and biased radially inwardly, as seen in FIG. 4, so as to be received in the recesses 36 in a snap fit relation. By providing the spring fingers 52 in this manner, the consumer is able to readily locate the proper position of the fluorescent tube on housing 16 and to automatically make the necessary electrical connection. Again, this type of connection permits the fluorescent tube to be disposed of once it has burned out.

As mentioned above the number of turns of the helical tube can be varied as desired in order to provide different light bulb wattage sizes. In any case however the helix typically will extend only up to a position adjacent the top of the housing 16 so as to form a compact light bulb assembly.

In accordance with another feature of the present invention, it is contemplated that the helical tube may for example be encased within a transparent glass envelope 54 (shown in dotted lines in FIG. 5) which will give the bulb the exterior appearance and configuration of a conventional incandescent light bulb. In this connection it is noted that in the embodiment of FIG. 5, to use a transparent envelope 54 as shown, a portion of the tube 36 would have to be eliminated and the lower contact 36 moved to a higher location to properly engage the lower end of the tube. In any case, the provision of envelope 54, in this manner, will enable the bulb to be used with conventional lamp shades which are designed to be secured to incandescent light bulbs.

In view of the construction of the bulb of the present invention, it will be appreciated that this bulb can be used in any conventional incandescent lamp socket interchangeably with incandescent light bulbs. The bulb of the invention provides substantial advantages over incandescent light bulbs in that they are more energy efficient, using approximately 1/6 of the energy of an equivalent incandescent light bulb. Moreover fluorescent light bulbs have a life expectancy which is up to 10 times longer than that of conventional incandescent light bulbs. Thus, the bulb of the invention represents a dual saving to the consumer not only in consumption of energy, but also in the number of bulbs required to be purchased for a particular light fixture.

It will be appreciated that the replacement of all incandescent light bulbs in a home with fluorescent light bulbs of the present invention will substantially reduce the energy costs for the consumer and will substantially reduce energy demands upon utility companies. For example, a 15 watt fluorescent bulb constructed in accordance with the present invention, having a 100 volt drop across the bulb and using a 150 milliampere ballast will have an expected energy loss or consumption of only 1 watt whereas a 90 watt incandescent light bulb, producing the same amount of light as the 15 watt fluorescent light bulb of the present invention, would use substantially greater amounts of energy. Moreover, the bulb of the present invention requires less frequent changing than incandescent light bulbs of equivalent size and is adapted to be used in incandescent lamp fixtures such as table lamps or the like wherein fluorescent light bulbs heretofore could not be used. In addition, the cool fluorescent light bulbs of the present invention are more convenient for the consumer to change, when necessary, since the electrical socket 18 may remain in the fixture during the bulb changing operation.

In order to further increase the light output from the bulb of the invention it is contemplated that the exterior surface of the housing 16 can be coated with a reflective material, such as aluminum, chrome, or sliver, and the like, so as to reflect the light dispersed towards the interior of the bulb from the inner surfaces of the fluorescent tube.

Figure 6:
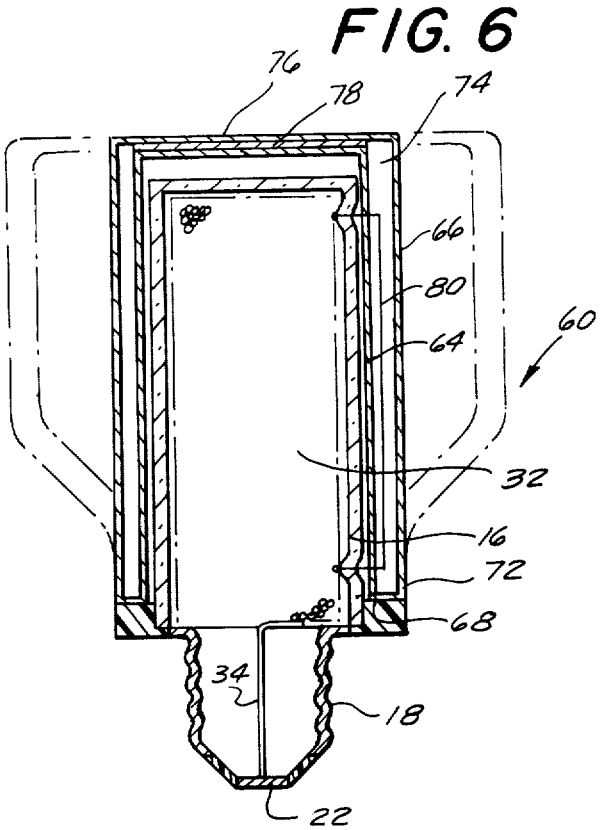
FIG. 6 is a sectional view, similar to FIG. 5 of another embodiment of the present invention.
Figure 7:
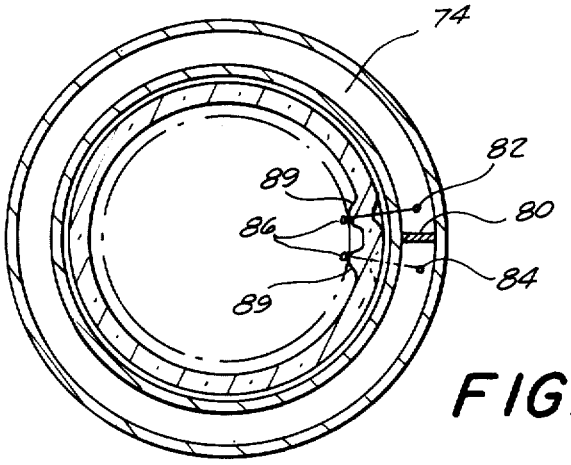
FIG. 7 is a plan view of the embodiment of FIG. 6.

A somewhat simplified embodiment of the fluorescent light bulb of the present invention is illustrated in FIGS. 6 and 7 of the drawings. The bulb 60 shown therein includes a central housing 16 having a socket plug 18 secured thereto and contains an electrical transformer or ballast 32, as in the previously described embodiments. In this embodiment, however, the fluorescent tube 62 is formed from a pair of glass cylinders 64,66 respectively. Cylinder 64 has an open end 68 which includes an outwardly extending peripheral flange 70 and an internal diameter which is slightly larger than the external diameter of ballast housing 16. Cylinder 66, on the other hand, has an open end 72 which abuts against flange 70 of cylinder 64 and is sealed thereto in any convenient manner to form a gas tight seal therebetween.

Cylinder 66 has an internal diameter which is substantially larger than the external diameter of cylinder 64 so that an annular chamber 74 is defined therebetween about the entire periphery of housing 16. In addition, the height of cylinder 66 is selected such that when its end 72 is sealed against flange 70, the top 76 of cylinder 66 is engaged with the top 78 of cylinder 64. It is contemplated that these top portions of the cylinders be sealed or fused together when the bulb is formed so that chamber 74 is toroidal in shape.

In order to provide an elongated discharge path for the fluorescent bulb of this embodiment, chamber 74 is provided with a separating or dividing panel 80 of glass or the like sealed in a gas tight relation between the cylinders 64,66 (see FIG. 7) along the entire length of the cylinders. After panel 80 is sealed to the cylinders, chamber 74 is evacuated and then filled with the required gas and sealed, to form the completed bulb.

A pair of elongated starter filaments 82, 84 respectively, are placed at each end of the annular discharge path in chamber 74 adjacent panel 80. These starter filaments are electrically connected to respectively associated contacts 86, which may be similar to the spring contacts 56 of the embodiment of FIGS. 4 and 5. These spring contacts provide, in turn, electrical contact between contacts 88 in depressions 89 on the surface of housing 16, which contacts extend through the housing into electrical connection with ballast 32.

The bulb formed by cylinders 64,66 is separable from housing 16, as will be appreciated, and spring contacts 86 thus provide a locating and snap fitting arrangement for the bulb similar to that provided by contacts 56 of the previously described embodiment of FIG. 4. Thus the bulb is readily removed and replaced when necessary.

It is noted, that in this embodiment of the invention both the outer surface of cylinder 64 and the inner surface of cylinder 66 may be coated with the fluorescent material. However, it is only necessary to coat the inner surface of cylinder 66 as it will be the most effective of the two surfaces for producing light.

In another form of the embodiment of FIG. 6, the outer cylinder or shell 66 may be formed in a configuration similar to that of a conventional incandescent light bulb, as shown in dotted lines in FIG. 6. Of course, in this case, panel 80 is formed along its outer edge to conform to the shape of outer shell 66 to insure a full gas tight seal therebetween. In this construction the bulb has the appearance of a conventional bulb but yet retains all of the advantages of a fluorescent bulb. Moreover it is more readily used in table lamp type structures particularly with lamp shade supports designed to be attached to the bulb itself.

Yet another embodiment of the invention is shown in FIG. 8. The bulb 90 shown therein is of substantially identical construction to that of FIG. 6, including inner and outer cylinders 64 and 66. Other corresponding elements are identified with corresponding numerals. However, in this form, in lieu of the flat panel 80, a spiral separator panel 92 is sealed between the cylinders in order to greatly increase the discharge path in the bulb and accordingly increase its light output. Thus, the helical panel 92 forms a helical discharge path in chamber 74 from the bottom to the top of the bulb. Moreover, cylinder 66 can have a greater height in this case so that the top 76 thereof is spaced from the top 78 of cylinder 64, thereby increasing the length of the helix and permitting production of light at the top of the bulb.

A starter element, similar to that used in the embodiments of FIG 1, is placed in chamber 74 of bulb 90 at each end of the spiral discharge path in chamber 74. These starter elements are connected to spring contacts 86 which in turn are adapted to be received in recesses 89 in housing 16 wherein they engage the contacts 88 for ballast 32. The spring contacts allow bulb 90 to be removed from housing 16 if necessary while simultaneously providing a convenient means for locating and securing the bulb to the housing.

It is to be understood that although the foregoing embodiments of the present invention have been described herein as utilizing fluorescent bulb constructions, such bulbs, and those described hereinafter, may also be formed as other types of gas vapor discharge bulbs, e.g. sodium vapor discharge bulbs, as would be apparent to those skilled in the art.

FIGS. 9 and 10 of the drawing illustrate two further embodiments of the invention using extruded glass envelopes to form the tube portions of the bulbs. The embodiment of FIG. 9 has a socket plug 18 connected to a ballast 16 having a generally rectangular configuration. A flourescent tube 100, having a generally U-shaped configuration, is operatively connected to the ballast. The tube 100 is an extruded element having a hollow chamber formed therein between its inner and outer walls 102, 104.

Preferably the tube is formed from an elongated extrusion as a one piece member having open ends, with the extrusion being cut into sections after it is formed, thereby providing a plurality of individual tules. The open end of each tube thus formed is closed and sealed in any convenient manner to permit the tube to be evacuated. As in the prior embodiments described above, the tube includes starter filaments 108 which are preferably located at the free ends of the U shaped form. This provides a relatively long discharge path for the tube. Of course the starter filaments are electrically connected to ballast 16; this connection being made by the use of any of the contact elements described above.

The bulb of FIG. 10 is similar to that of FIG. 9 in that an extruded element 110 is used to form the tube of the bulb assembly. In this case tube 110 is a generally cylindrical extrusion having its ends 112 closed in any convenient manner to seal the tube against gas leakage. The abutting ends 114 of the extrusion contain the starter filaments 118 to provide an elongated discharge path about the central circular or cylindrical ballast 16. The filaments 118, of course, are electrically connected to the ballast in any convenient manner.

The bulb 120 shown in the embodiment of FIGS. 11 and 12 uses a two piece tube construction 122 which surrounds the central cylindrical ballast 16. Tube 122 is formed from an outer cylindrical tube 124 having an elongated or extended recess (which may be semi-circular as shown) formed about its periphery. The recess can be formed in any convenient or desired path configuration and includes two adjacent closed or separated ends 128 which contain the starter filaments 118. Recess 126 is closed by an inner cylindrical tube 130 whose outer diameter is equal to the inner diameter of tube 124. Tube 130 is sealed in gas tight relation to tube 124 along their mating surfaces, thereby to form a gas discharge bath in recess 126. Of course, recess 126 is coated with fluorescent material or contains a suitable gas discharge vapor in order to produce light when filaments 118 are connected to ballast 16.

Although illustrative embodiments of the present invention have been described herein with reference to the accompanying drawings it is to be understood that the invention is not limited to those precise embodiments, and that various changes and modifications can be effected therein by one skilled in the art without departing from the scope or spirit of this invention.

What is claimed is:

1. A fluorescent light bulb adapted for use in an incandescent lamp fixture comprising, a central ballast, a socket plug electrically connected to said ballast and adapted to be received in the socket of an incandescent lamp fixture, and a fluorescent tube containing a gas discharge vapor and having an interior surface coated with a fluorescent material, said tube comprising means defining a relatively flat toroid which is generally complementary to the periphery of said ballast and surrounding said central ballast and being electrically connected to said ballast thereby to form a compact fluorescent light bulb assembly.

2. The fluorescent light bulb as defined in claim 1 wherein said tube includes a pair of generally cylindrical radially spaced walls defining a closed chamber therebetween for containing fluorescent gases, said ballast being received in and generally complementary to the inner most of said cylindrical walls.

3. The fluorescent light bulb as defined in claim 2 including panel means in said chamber for separating said chamber and defining a vapor discharge path therein.

4. A fluorescent light bulb adapted for use in an incandescent lamp fixture comprising, a central ballast, a socket plug electrically connected to said ballast and adapted to be received in the socket of an incandescent lamp fixture, and a fluorescent tube surrounding said central ballast and being electrically connected to said ballast thereby to form a compact fluorescent light bulb assembly; said tube comprising a relatively flat toroid which is generally complementary to the periphery of said ballast and including a pair of generally cylindrical radially spaced walls defining a closed chamber therebetween for containing fluorescent gases, said ballast being received in and generally complementary to the innermost of said cylindrical walls; and helical panel means in said chamber extending through the length of said chamber between said cylindrical walls for separating said chamber and defining a helical vapor discharge path therein.

5. The fluorescent light bulb as defined is claim 4 including starter elements at opposite ends of said discharge path and contacts therefore removably connected to said ballast.

6. A gas discharge light bulb adapted for use in an incandescent lamp fixture to replace an incandescent bulb, comprising a ballast, a socket plug electrically connected to said ballast and adapted to be received in the socket of an incandescent lamp; and means defining a vapor discharge envelope of the approximate size of an incandescent bulb, electrically connected to said ballast thereby to form a compact vapor discharge light bulb assembly; said means comprising first and second tubular members positioned in telescopic relation to each other; one of said tubular members having an elongated recess formed therein opening towards the other of said tubes; said first and second tubular members being sealed therebetween in gas tight relation to close the open side of said recess and define a gas vapor discharge path in the tube.

* * * * *